United States Patent [19]

Schumacher

[11] 4,172,435

[45] Oct. 30, 1979

[54] COOLED CYLINDER FOR AN INTERNAL COMBUSTION ENGINE

[75] Inventor: Arnold Schumacher, Winterthur, Switzerland

[73] Assignee: Sulzer Brothers Limited, Winterthur, Switzerland

[21] Appl. No.: 856,489

[22] Filed: Dec. 1, 1977

[30] Foreign Application Priority Data

Dec. 15, 1976 [CH] Switzerland ..... 15757/76

[51] Int. Cl.[2] ..... F02F 1/14

[52] U.S. Cl. ..... 123/41.72; 123/41.79; 123/41.84; 92/171

[58] Field of Search ..... 123/41.72, 4174, 41.79, 123/41.82 R, 41.84, 41.83, 41.81, 41.8; 92/169, 170, 171

[56] References Cited

U.S. PATENT DOCUMENTS

| | | | |
|---|---|---|---|
| 1,500,861 | 7/1924 | Zbinden | 123/41.84 |
| 1,904,459 | 4/1933 | Hefti | 123/41.8 |
| 2,023,967 | 12/1935 | Morris et al. | 123/41.84 |
| 2,464,462 | 3/1949 | Ricardo | 123/41.74 |
| 2,858,815 | 11/1958 | Burrows | 123/41.82 |
| 3,714,931 | 2/1973 | Neitz et al. | 123/41.79 |
| 3,745,980 | 7/1973 | Pekar, Jr. et al. | 123/41.74 |
| 4,050,421 | 9/1977 | Cendak | 123/41.72 |

FOREIGN PATENT DOCUMENTS

| | | | |
|---|---|---|---|
| 973009 | 11/1959 | Fed. Rep. of Germany | 123/41.72 |
| 2015948 | 10/1971 | Fed. Rep. of Germany | 123/41.72 |
| 2149400 | 4/1973 | Fed. Rep. of Germany | 123/41.79 |
| 546955 | 11/1922 | France | 123/41.84 |
| 552635 | 5/1923 | France | 123/41.72 |
| 910675 | 8/1947 | France | 123/41.8 |
| 597790 | 2/1948 | United Kingdom | 123/41.72 |

*Primary Examiner*—Charles J. Myhre
*Assistant Examiner*—Jeffrey L. Yates
*Attorney, Agent, or Firm*—Kenyon & Kenyon

[57] ABSTRACT

An annular member is fitted about an extension of the cylindrical liner and is provided with a pair of concentric chambers. The inner chamber communicates with cooling ducts within the liner while the outer chamber communicates via a single conduit with cooling cavities in the cylinder head. One or more throttle openings are provided between the two chambers to throttle the flow of coolent between the chambers. The annular member is provided with suitable apertured partitions to permit bolts to pass through in order to secure the cylinder head to the cylinder block.

7 Claims, 3 Drawing Figures

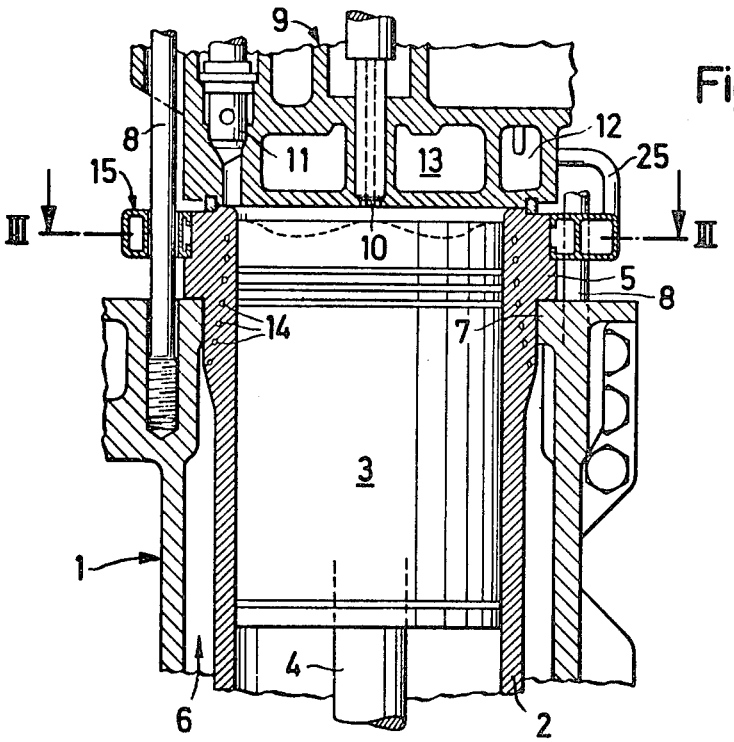
Fig.1
Fig.2
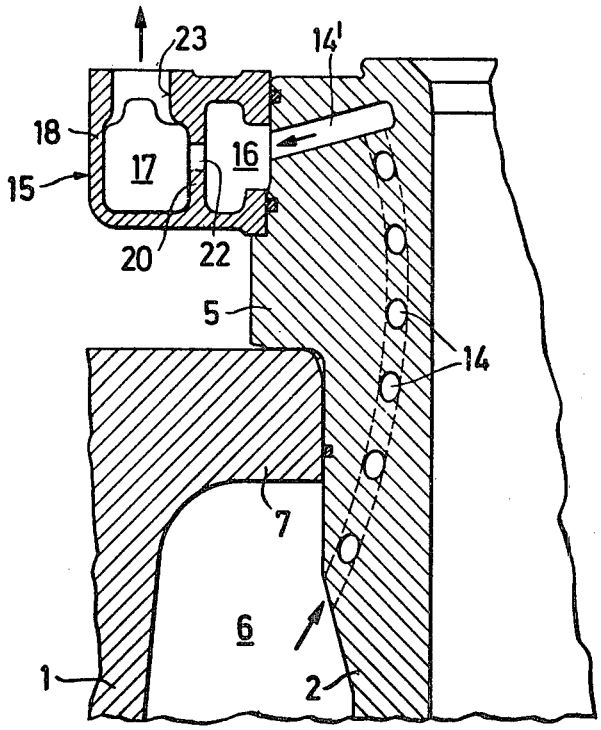

COOLED CYLINDER FOR AN INTERNAL COMBUSTION ENGINE

This invention relates to a cooled cylinder for an internal combustion engine.

As is known, internal combustion engines are generally formed of a cylinder block in which a number of cylindrical liners in the form of sleeves are positioned so as to guide reciprocating pistons. In many cases, these cylinder liners are disposed in the cylinder block to define coolant chambers through which a coolant may flow to cool the sleeve and block. Further, the liners may also be provided with cooling ducts which are distributed over the circumference of the top part of the liners to cool the top of the liner. Usually, these ducts communicate the flow of coolant in the cylinder block with a cavity within a cylinder head mounted above the cylinder block. In such cases, the cylinder heads are detachably connected to the cylinder block and are carried on the cylinder liners. In one known internal combustion engine of this type, e.g. as described in U.S. Pat. No. 4,050,421, a flat ring is placed around each liner in the region of the outlets of the cooling ducts and a plurality of conduits are connected between the flat ring and the cylinder head in order to conduct the coolant from the cooling ducts to the cylinder head. Usually, a number of cooling duct outlets is associated with each of the conduits.

However, in these constructions, it has been impossible to obtain a uniform cooling of the circumference of the cylinder liner in view of the type of coolant transfer from the liner to the cylinder head. This has resulted in leakages between the cylinder liner and the cylinder head and, hence, the escape of gas from the combustion chamber of the cylinder. Although it is possible to obtain a more uniform cooling of the top zone of the cylinder liner by increasing the number of conduits connected to the flat ring, there still remains the disadvantage that considerable labor and time are required to dismantle the cylinder head since all the conduits connected to the ring then have to be disconnected.

Accordingly, it is an object of the invention to provide for a relatively uniform cooling of the cylinder liner of an internal combustion engine.

It is another object of the invention to provide a simple means of uniformly cooling the upper zone of a cylinder liner of an internal combustion engine.

It is another object of the invention to permit a relatively easy dismantling of a cylinder head from a water cooled cylinder and block of an internal combustion engine.

Briefly, the invention is directed to a cylinder block of an internal combustion engine wherein a cylinder liner is disposed in the block to define an annular chamber and a cylinder head which is detachably connected to the cylinder block. The liner has an end which projects outside of the block as well as a plurality of cooling ducts which are circumferentially closed within the liner. Each of these cooling ducts is in communication with the coolant chamber within the block and extends to an outlet in the end of the liner. Further, the cylinder head is abutted against the end of the liner and has cavities therein to receive a coolant. In accordance with the invention, a pair of chambers are disposed concentrically of the liner end. An inner one of the chambers is in communication with each outlet of the cooling ducts to receive coolant while the outer chamber is connected by way of a single conduit with the cavities of the cylinder head so as to deliver the coolant to the cavity. In addition, at least one throttle opening communicates the inner chamber with the outer chamber.

The pair of concentric chambers are housed within an annular member which is fitted in seal-tight relation on an outer circumferential surface of the liner end and has further a rectangular cross-section. The chambers are separated by a partition which extends in the form of a polygon between the chambers. The throttle openings are formed in this partition. The partition also has a thickened portion at each corner and a bore which extends through each thickened portion. These bores accommodate bolts which extend through each bore in order to connect the cylinder head to the cylinder block. Finally, the inner chamber of the annular member has a circumferential aperture which faces and is in the plane of the outlets of the cooling ducts.

The single conduit which conducts the coolant to the cavities in the cylinder head may also be provided with a shut-off member in order to control the flow.

The arrangement of the two concentric chambers and the throttles between the two chambers provides a simple means of insuring that the coolant exit speed from the cooling ducts is made more uniform and that a more uniform temperature is obtained over the circumference of the cylinder liner.

The invention thus provides a construction wherein the thermal stresses in the top zone of the cylinder liner are greatly reduced and in which the risk of cracking is also diminished. Another advantage is that the circular geometry of the piston rings is maintained as a result of the uniform cooling. Still further, by using only a single connecting conduit to the cylinder head, the expenditure of time and labor for dismantling the cylinder head is very greatly reduced. The use of a single connecting conduit also simplifies the engine construction while facilitating accessability to the individual components of the engine.

By placing the concentric chambers in a unitary annular member which can be simply detached from the liner, production and installation of the chambers of the liner are facilitated.

Despite the presence of the two annular chambers, the bores which are formed in the partition allow the connecting bolts between the cylinder head and the cylinder block to be disposed near the circumference of the cylinder liner in a space saving arrangement.

These and other objects and advantages of the invention will become more apparent from the following detailed description taken in conjunction with the drawings in which:

FIG. 1 illustrates an axial sectional view through a top part of a cylinder and a part of a cylinder head made in accordance with the invention;

FIG. 2 illustrates an enlarge scale view of a section through the top end of a cylinder liner with two annular chambers about the liner in accordance with the invention.

Figure 3:
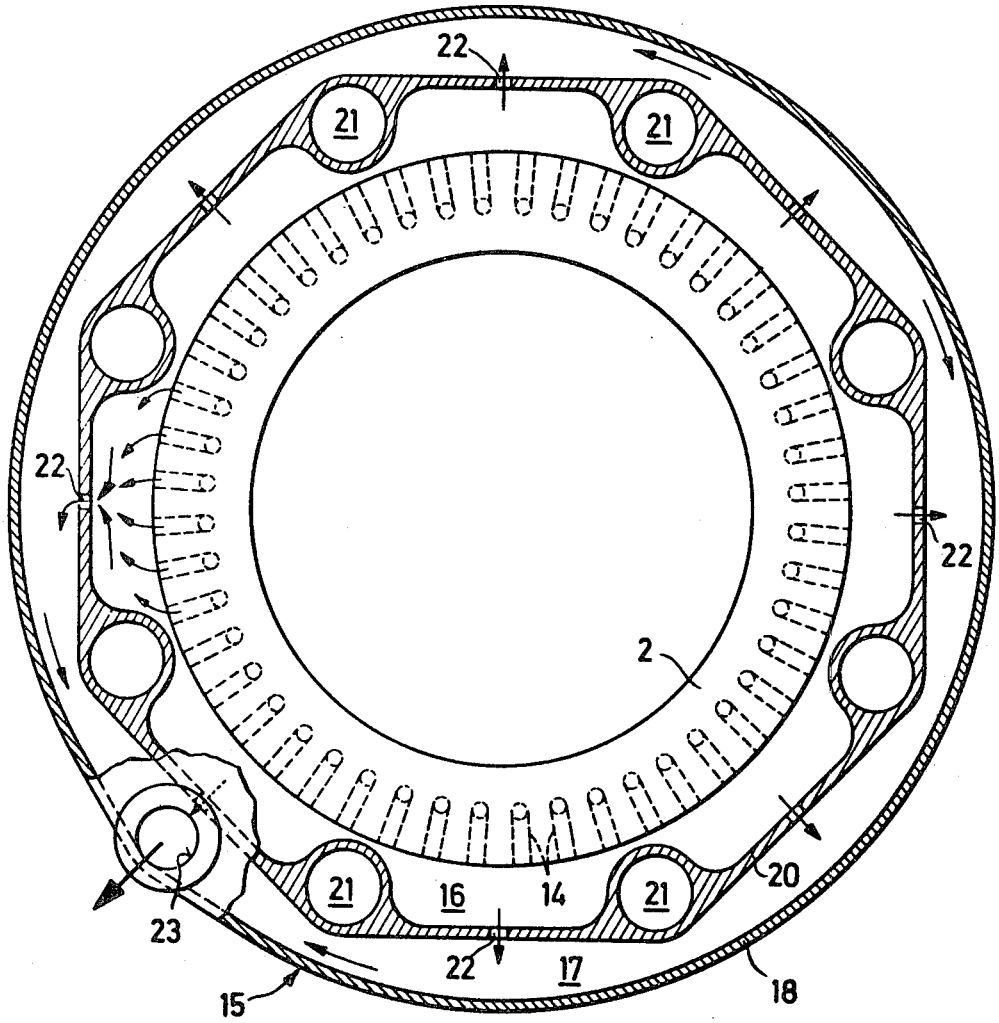
FIG. 3 illustrates a view taken on line III—III of FIG. 1.

Referring to FIG. 1, the internal combustion engine, for example a diesel engine of the V-type is constructed with a cylinder block 1 and a plurality of cylinder liners 2 (only one of which is shown for simplicity). As shown, the cylinder liner 2 is disposed in the block 1 to define an annular coolant chamber 6 therebetween for a coolant such as water. A piston 3 is disposed in the sleeve 2 and is adapted to reciprocate vertically in the cylinder liner 2 via a connecting rod 4 which is pivotally connected to the piston 3. The top end of the cylinder liner 2 projects outside of the cylinder block 1 and has an outwardly extending flange 5 at that end which rests on the cylinder block 1. As shown in FIG. 2, the wall of the cylinder block 1 is provided with a constriction 7 at the top end so as to bear against the cylinder liner 2 in seal-tight relation. The bottom end of the cylinder block 1 (not shown) is also constricted in a similar manner to bear against the cylinder liner 2 in seal-tight relation.

A cylinder head 9 is abutted against the liner end and is detachably connected to the cylinder block 1 via stud bolts 8 which are distributed over the circumference of the liner 2 and fixed in the casing 1. The cylinder head 9 contains a fuel injection nozzle 10, inlet and exhaust valves (not shown) and a starting up valve 11. In addition, the head 9 contains a number of cavities 12, 13 which carry a flow of water and which are interconnected in a suitable manner (not shown). Referring to FIGS. 2 and 3, the liner 2 is provided with a plurality of cooling ducts 14, for example 48 ducts. These cooling ducts 14 extend rectilinearly and upwardly and are distributed uniformly over the circumference of the cylinder liner 2 in the region of the flange 5 and the constriction 7 of the cylinder block 1. The bottom ends of the cooling ducts 14 are in communication with the coolant chamber 6 and extend to outlets in the end of the cylinder liner 2.

Referring to FIG. 2, an annular member 15 is fitted in seal-tight relation about the liner 2 above the flange 5. This annular member has a pair of concentric chambers 16, 17 which are disposed one inside the other. The inner chamber 16 has a circumferential aperture which faces and is in the plane of the outlets of the cooling ducts 14 in order to receive coolant therefrom. As shown, each duct 14 extends via a radial duct 14' as far as the outer circumference of the cylinder liner 2. The inner chamber 16 thus forms a collecting chamber for the cooling water flowing through the ducts 14, 14' from the annular coolant chamber 6.

Referring to FIGS. 2 and 3, the annular member 15 has a continuously extending partition 20 between the concentric chambers 16, 17 which is in the form of a polygon, for example a regular octagon, as viewed in plan. The partition 20 is provided with a thickened portion at each corner which extends close to the cylinder liner 2 and through which a bore 21 extends. In this way, the inner chamber 16 is subdivided into eight sections by the thickened portions of the partition 20. These eight sections are thus pressure-balanced with respect to one another. Each of the bores 21 permits the passage of one of the stud bolts 8 as indicated in FIG. 1.

Referring to FIG. 2, the partition 20 is provided with a plurality of throttle openings 22 which communicate the inner chamber 16 with the outer chamber 17. As shown in FIG. 3, each throttle 22 is positioned between two of the thickened portions of the partition 20 to allow the cooling water to pass from the inner chamber 16 to the outer chamber 17. As shown in FIGS. 2 and 3, the outer chamber 17 has a single exit aperture 23 at the top of the annular member 15 while a single conduit 25 is connected between the exit aperture 23 and the cylinder head 9. This conduit 25 (FIG. 1), although not shown in detail, connects the outer chamber 17 to the water cavities 12, 13 in the cylinder head 9. In addition, a shut-off member can be provided in the conduit 25 in order to control the flow of water.

Referring to FIG. 2, when the diesel engine is in operation, the cooling water flows from the cooling chamber 6 into the cooling ducts 14 of the cylinder liner 2 so that the liner 2 is intensively cooled in the top zone. This zone is the one which is subjected to the greatest temperature and pressure stresses. From the cooling ducts 14, the cooling water flows via the radial ducts 14' into the inner chamber 16 wherein the eight throttle openings 22 distributed uniformly over the circumference of the partition 20 insure a uniform exit speed of the water from the ducts 14'. The cross-sections of the throttle openings 22 are so dimensioned that the speed of the water squared ($V^2$) in the throttle zones is at least ten times that in cross-sections 14' and in the cross-sections of the narrowest points between the thickened portions of the partition 20 and the outer wall 18 of the annular member 15. After passing through the throttle openings 22, the cooling water flows to the outer chamber 17. Next, the cooling water flows through the exit aperture 23 into the conduit 25 and passes to the cylinder head 9. The water then flows through the cavities 12, 13 in the cylinder head.

In order to dismantle the cylinder head 9, the conduit 25 can be simply disconnected and the bolts 8 removed.

It is to be noted that it is possible to dispose the exit aperture 23 of the annular member 15 in the outer wall 18. It is also possible for the outer chamber 17 to extend only over a portion of the circumference of the member 15, that is over $\frac{1}{2}$ of the circumference of the member 15. In this case, the partition 20 would be combined with the outer wall 18 at the two ends of the shortened chamber 17. Further, rather than being of circular shape the outer wall 18 would extend at a smaller distance from the cylinder liner 2 in the section between the ends of the chamber 17. A configuration of this kind may become necessary for space reasons.

What is claimed is:

1. In combination, a cylinder block for an internal combustion engine;

a cylinder liner disposed in said block to define coolant chamber therebetween, said liner having an end projecting outside said cylinder block and a plurality of cooling ducts circumferentially disposed therein, each said cooling duct being in communication with said coolant chamber and extending to an outlet in said end;

a cylinder head detachably connected to said cylinder block and abutted against said liner end, said cylinder head having cavities therein to receive a coolant;

a pair of chambers disposed concentrically of said liner end, an inner one of said chambers being in communication with each outlet of said cooling ducts to receive coolant therefrom; at least one throttle opening communicating said inner chamber with the outer one of said chambers; and a single conduit connecting said outer chamber with said cavities of said cylinder head to deliver coolant to said cavities.

2. The combination as set forth in claim 1 which includes an annular member housing said concentric chambers, said annular member being fitted in seal-tight relation on an outer circumferential surface of said liner end, and said member has a rectangular cross-section.

3. The combination as set forth in claim 2 wherein said annular member has a partition extending in the form of a polygon between said concentric chambers, said partition having said throttle opening therein.

4. The combination as set forth in claim 3 wherein said partition has a thickened portion at each corner thereof and a bore extending through each thickened portion, and which further includes a bolt extending through each respective bore to connect said cylinder head to said cylinder block.

5. The combination as set forth in claim 2 wherein said annular member has a circumferential aperture facing and in the plane of said outlets of said cooling ducts.

6. The combination as set forth in claim 1 which further comprises a shut-off member in said conduit.

7. In combination a cylinder block for an internal combustion engine;

a cylinder liner disposed in said block to define a coolant chamber therebetween, said liner having an end projecting outside said block and a plurality of cooling ducts therein, each said cooling duct being in communication with said coolant chamber and extending to an outlet in said end;

an annular member fitted in seal-tight relation about said liner end, said member having a pair of concentric chambers therein and at least one throttle opening communicating said chambers with each other, one of said chambers being in communication with said outlets of said cooling ducts to receive coolant therefrom;

a cylinder head detachably connected to said block and abutted against said liner end, said head having cavities therein to receive coolant; and a single conduit connecting the other of said chambers in said annular member with said cavities of said head to deliver coolant to said cavities.

* * * * *

UNITED STATES PATENT AND TRADEMARK OFFICE

CERTIFICATE OF CORRECTION

PATENT NO. : 4,172,435

DATED : October 30, 1979

INVENTOR(S) : Arnold Schumacher

It is certified that error appears in the above-identified patent and that said Letters Patent are hereby corrected as shown below:

Column 1, line 55, after "annular" insert --cooling--

Column 4, line 31, after "over" insert --3/4--

Signed and Sealed this

*Fifth* Day of *February 1980*

[SEAL]

*Attest:*

SIDNEY A. DIAMOND

*Attesting Officer*

*Commissioner of Patents and Trademarks*